US005587099A

United States Patent [19]

Kuhn et al.

[11] Patent Number: 5,587,099

[45] **Date of Patent: *Dec. 24, 1996**

[54] SAFETY CONTAINER FOR MICROWAVE OVEN BAKING UTENSIL

[76] Inventors: James O. Kuhn, Box 444 203 Litchfield Rd., Norfolk, Conn. 06058; Lee J. Goldman, 23 Buckingham Ave., Harvey Cedars, N.J. 08008

[ * ] Notice: The portion of the term of this patent subsequent to Mar. 7, 2012, has been disclaimed.

[21] Appl. No.: 332,137

[22] Filed: Oct. 31, 1994

Related U.S. Application Data

[63] Continuation-in-part of Ser. No. 166,517, Dec. 13, 1993, Pat. No. 5,396,051, and Ser. No. 173,784, Dec. 27, 1993.

[51] Int. Cl.[6] ..... H05B 6/80

[52] U.S. Cl. ..... 219/728; 219/710; 219/762; 426/243; 99/DIG. 14

[58] Field of Search ..... 219/679, 710, 219/759, 730, 762, 728; 220/201; 426/107, 241, 243; 99/DIG. 14

[56] References Cited

U.S. PATENT DOCUMENTS

| | | | |
|---|---|---|---|
| 2,125,419 | 8/1938 | Birk | 220/201 |
| 2,565,361 | 8/1951 | Elm | 220/201 |
| 3,420,923 | 1/1969 | Ashworth et al. | 219/759 |
| 3,429,359 | 2/1969 | Hollingsworth | 219/762 |
| 3,511,899 | 5/1970 | Miller et al. | 425/174.8 R |
| 3,559,839 | 2/1971 | Seethaler | 220/201 |
| 3,585,258 | 6/1971 | Levinson | 219/759 |
| 4,822,966 | 4/1989 | Matsubara | 219/759 |
| 4,882,463 | 11/1989 | Kyougoku et al. | 219/730 |
| 5,396,051 | 3/1995 | Kuhn et al. | 219/679 |

*Primary Examiner*—Philip H. Leung
*Attorney, Agent, or Firm*—Michael Ebert

[57] ABSTRACT

A safety container for a baking utensil provided with a thermal heating element having ferrites dispersed therein, which utensil when placed in a microwave oven and is exposed to microwave energy, converts this energy into thermal energy for cooking the food therein. The safety container in which the utensil is housed includes a removable cover and a temperature-responsive latching mechanism which releases the cover to permit withdrawal of the utensil from the container only when the utensil has cooled to a temperature level at which it is safe to handle.

7 Claims, 1 Drawing Sheet

FIG. 1
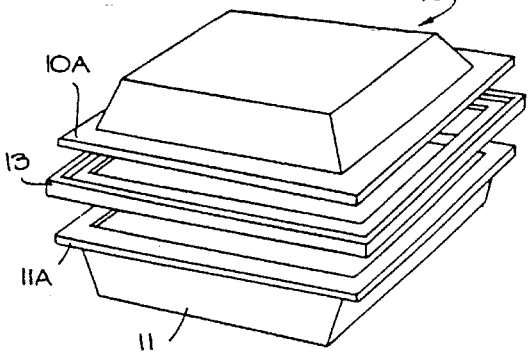
FIG. 2
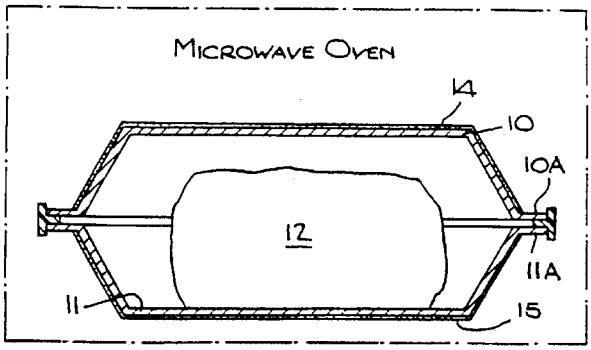
FIG. 3
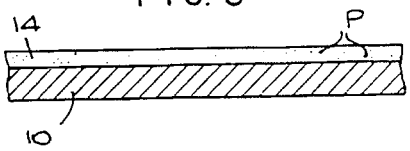
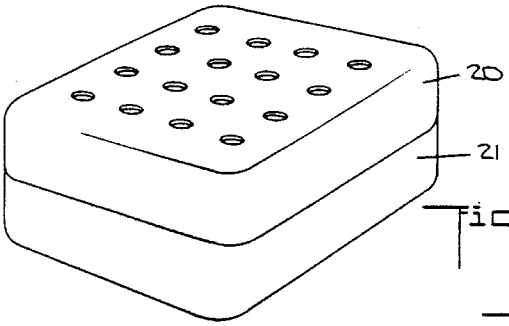
Fig. 4
Fig. 5
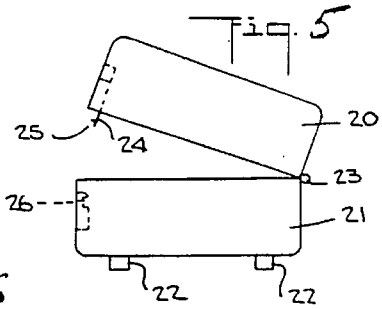
Fig. 6
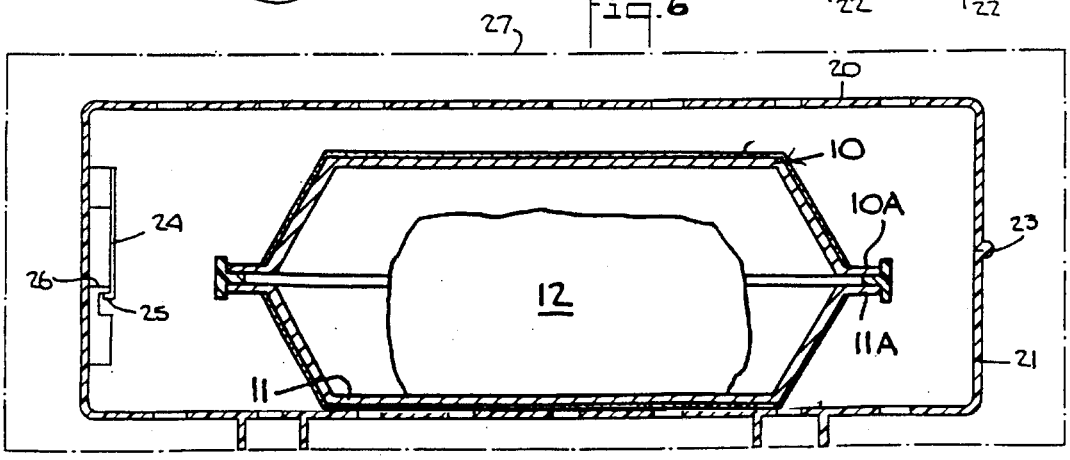

SAFETY CONTAINER FOR MICROWAVE OVEN BAKING UTENSIL

RELATED APPLICATIONS

This application is a continuation-in-part both of our applications Ser. No. 08/166,517, filed Dec. 13, 1993, entitled "SAFETY CONTAINER FOR MOLD ASSEMBLY IN MICROWAVE OVEN" (now U.S. Pat. No. 5,396,051) and Ser. No. 08/173,784, filed Dec. 27, 1993, entitled "BAKING UTENSIL TO CONVERT MICROWAVE ENERGY INTO THERMAL ENERGY," the entire disclosures of these pending applications are being incorporated herein by reference.

BACKGROUND OF INVENTION

1. Field of Invention

This invention relates generally to baking utensils, and more particularly to a utensil adapted to operate in a microwave oven to convert microwave energy to which the utensil is exposed to thermal energy for cooking the food contained therein, and more particularly to a safety container for protectively housing a utensil of this type so that when cooking is completed it cannot be removed from the container until the utensil has cooled to a temperature level at which it is safe to handle.

2. Status of Prior Art

Baking is the process of cooking food with dry heat. Heat is transferred to the food by convection, conduction or infrared radiation, depending on the nature of the oven. But in all cases, thermal energy is applied to the outer surface of the food and by reason of heat transfer from this surface to the inner body of the food, cooking takes place from the outside in. As a consequence, as cooking continues, the surface of the food may become scorched or browned. Because this action usually renders the food more palatable, such surface scorching or browning is normally regarded as desirable.

The use of a microwave oven to heat or cook food is commonplace, and microwave ovens are now installed in many households. In the typical microwave oven, a magnetron functions to generate microwave energy at a frequency of about 1000 mHz. This energy is conveyed by a wave guide to the interior of the oven to irradiate the food placed therein. Because food more or less absorbs microwave energy, this gives rise to internal molecular friction which heats the food at a rate that depends on its "lossy" characteristics. Some food products are heated more rapidly than others in a microwave oven; but in general the cooking of food by microwave energy is much faster than by conventional heating techniques, including infrared radiation.

In heating or cooking food in a microwave oven, the food is placed in a receptacle of synthetic plastic, glass or other material which is non-reactive to microwave energy; hence, it is only the food that is heated. U.S. Pat. Nos. 4,703,149 and 4,416,906 disclose microwave food heating utensils. In some cases, as pointed out in U.S. Pat. No. 4,416,906, microwave cooking of food is uneven because of dry spots in some areas of the food and moist spots in other areas.

Cooking takes place in a microwave oven throughout the body of the food; hence browning or scorching of the outer surface or crust does not occur. Thus if one sought to bake a loaf of bread in a microwave oven it would have no crust. This is a recognized disadvantage of microwave cooking.

U.S. Pat. No. 3,941,967 discloses a microwave cooking apparatus capable of scorching the surface of the food being cooked without excessively heating the interior of the food. This apparatus, which is designed to be put into a microwave oven, takes the form of a casing within which is disposed a plate on which the food to be cooked is placed. Below the plate is a thermal heating element which generates heat by absorption of microwave radiation, use for this purpose being made of a ferrite heating element. Thus, the interior of the food is heated by the microwave energy absorbed thereby, while at the same time the exterior of the food is thermally heated and scorched by the plate heated by the ferrite heating element.

A similar arrangement is shown in U.S. Pat. No. 4,496,815, in which a microwave browning utensil includes a metal platter on which the food to be heated in the microwave oven is placed. On the underside of the platter is a thermal heating element formed by powdered ferrites dispersed in a matrix. In this way, the interior of the food on the platter which absorbs microwave energy is heated and cooked thereby, while its exterior is thermally heated and browned. Thermal heating takes place mainly by conduction; hence, the exterior of a body being heated is first subjected to the heat before it penetrates the interior of the food body, whereas with microwave heating, the radiation penetrates the interior of the body.

U.S. Pat. No. 4,266,108 discloses the use of ferrite material adjacent a microwave reflecting member in which the ferrite material acts as a heating element that will rise in temperature to a predetermined level which depends on the Curie point of thee ferrite. U.S. Pat. No. 4,664,506 discloses an aluminum microwave cooking vessel having discrete layers of ferrite particles bonded thereto to convert microwave energy to thermal energy. When in its ferromagnetic state, the ferrite then absorbs microwave energy and is heated thereby. This action ceases when the ferrite enters its paramagnetic state. Hence, when a ferrite heating element is placed in a microwave oven and is subjected to microwave energy, the heating element will become increasingly hot until an elevated temperature is reached that depends on the Curie point of the ferrite, after which no more heat is generated even though the microwave oven is still operating. Thus, the ferrite heating element will effectively be turned "off," even though the microwave oven is still "on."

Our above-identified application, Ser. No. 08/173,784 discloses a baking utensil adapted to operate in a microwave oven to convert microwave energy to which the utensil is exposed into thermal energy for cooking food contained therein. The utensil is composed of complementary, thermally-conductive upper and lower sections, each having bonded to its outer surface an epoxy matrix layer. Dispersed throughout the matrix layer are ferrite particles which absorb microwave energy to produce thermal energy that is conducted by the sections of the utensil to the food enveloped thereby. The Curie point of the ferrite particles is such as to arrest their absorption of microwave energy when the utensil temperature approaches a level which is excessive for the food product being cooked or baked.

One who puts this utensil in a microwave oven does not exactly know how long it take for baking or cooking of food to be completed and therefore sets the microwave oven to turn off after a time period that is beyond the estimated cooking time. However, no danger exists that the food will be overcooked, for the Curie point of the ferrite particles is such as to cut off thermal heating when the utensil temperature exceeds a predetermined level. However, when cooking is completed and the utensil is to be removed from the microwave oven, the person who then removes the utensil from the oven runs the risk of being burned, for the utensil is still very hot.

In our above-identified copending application Ser. No. 08/173,784 there is disclosed a safety container for a mold assembly for use by children to produce in a microwave oven shaped plastic play pieces, the assembly including a ferrite heating element responsive to microwave energy which acts to thermally heat the plastic material held in the mold assembly. This safety container which houses the mold assembly includes a removable cover which is latched when the heating element raises the temperature in the oven to a high level, and is automatically unlatched when the temperature is relatively cool so that the child can then safely remove the mold assembly from the container.

SUMMARY OF INVENTION

The main object of this invention is to provide a safety container for housing a baking utensil which when placed in a microwave oven and exposed to microwave energy then converts this energy to thermal energy to cook the food therein, the safety container acting to prevent the removal of the utensil therefrom when its temperature is high and permitting such removal when the temperature is reduced to a level at which it can safely be handled.

More particularly, an object of this invention is to provide a safety container for housing a microwave baking utensil which does not interfere with the baking operation being carried out in a microwave oven, the container including a releasable cover that is only released when the utensil has cooled to a degree where it is safe to handle.

Briefly stated, these objects are attained in a safety container for housing a baking utensil that include a ferrite heating element which when the utensil is placed in a microwave oven and is subjected to microwave energy converts this energy to thermal energy to cook food held in the utensil.

The safety container includes separable upper and lower sections of a synthetic plastic .material that is insensitive to microwave energy for housing the utensil, the upper section functioning as a removable cover. The container is provided with latching means which latch the sections together when the heating element raises the temperature of the utensil in the oven to a high level and automatically unlatches the sections when the temperature is relatively cool so that one can then safely remove the utensil from the container.

BRIEF DESCRIPTION OF DRAWING

For a better understanding of the invention as well as other objects and features thereof, reference is made to the following detailed description to be read in conjunction with the accompanying drawing wherein:

FIG. 1 is an exploded view of a utensil in accordance with the invention;

FIG. 2 is a section taken through the utensil;

FIG. 3 is a section taken through the wall of a section of the utensil;

FIG. 4 shows in perspective a safety container in accordance with the invention for the utensil, the container being latched;

FIG. 5 illustrates the container in its unlatched state; and

FIG. 6 schematically illustrates the utensil enclosed within the container placed in a microwave oven.

DETAILED DESCRIPTION OF INVENTION

The Utensil:

Referring now to FIG. 1 of the drawing, it will be seen that a microwave cooking utensil in accordance with the invention includes complementary upper and lower half metal sections 10 and 11, each in the form of a generally rectangular tray whose rim is provided with a flange 10F and 11F, respectively. A preferred metal for this purpose is zinc or steel which has a high thermal conductivity, but is insensitive to microwave energy.

When the upper and lower half section 10 and 11 are combined to complete the utensil, as shown in FIG. 2, to envelop a food product 12 placed within the utensil, flange 10F of the upper section then is superposed over flange 11F of the lower section. Sandwiched between flanges 10F and 11F is a frame-shaped spacer 13 formed of polypropylene or other dielectric material to prevent sparking between the flanges when the utensil is exposed to microwave energy in a microwave oven. In practice the corners of the flanges and the frame are preferably rounded, for sharp edges are to be avoided in a microwave oven.

While the utensil illustrated herein is shown as being composed of a pair of rectangular tray-like sections, it is to be understood that the invention is by no means limited to this preferred embodiment, for a utensil in accordance with the invention, while it must have complementary upper and lower sections, these sections may be in a round, an octagonal or in any other shape. Thus the upper section of the utensil may take the form of a lid for a tray like lower section.

Bonded to the outer surface of the shaped upper section 10 of the utensil is a matrix layer 14 of epoxy resin material or any other dielectric material which is strongly adherent to the outer surface of the metal. Similarly bonded to the outer surface of the shaped lower section 11 of the utensil and conforming thereto is a matrix layer 15 of epoxy resin material. The advantage of an epoxy resin is that it is capable of surviving rough handling and should the utensil be dropped on a hard surface or otherwise mishandled, the epoxy layer will remain attached to the metal and will not crack.

Dispersed throughout the epoxy matrix layers 14 and 15 which are non-reactive to microwave energy, are fine ferrite particles P as shown in FIG. 3. These particles are highly reactive and absorb microwave energy. The term "ferrites" refers to magnetic oxides containing iron as a major component. It is the high electrical resistivity of ferrites that distinguish them from magnetic metals. The three most common groups of ferrites are those characterized as spinels, garnets and hexagonal ferrites. The spinel ferrites have the chemical formula $MeFe_2O_4$. The garnet ferrites have the general formula $3MeO_25Fe_2O_3$, while the composition of hexagonal ferrites include barium. Available ferrites have Curie points in the range of about 80° C. to over 500° C. The ferrite layers covering the sections of the metal sections shield the food contained in the utensil from microwave energy so that no microwave cooking takes place.

The ferrites dispersed in the matrix layers absorb microwave energy and produce thermal energy that is conducted by the metal upper and lower sections 10 and 11 to the food product 12 enveloped by the utensil to effect cooking of the product from the outside in. The Curie point of the ferrites is such as to cut off the production of thermal energy when its temperature approaches a level that is excessive for cooking the food product contained in the utensil.

In thermally cooking a particular food product whose cooking time is more or less known, there is no need to set the microwave oven timer so that the oven operates for a period just sufficient to effect thermal cooking of the food placed in the oven. In practice the microwave oven may be set for a time period beyond the anticipated cooking time, for when the energy produced by the utensil approaches an excessive level, because of the Curie point of the ferrites, the production of thermal energy cuts off automatically.

The Safety Container:

As illustrated in FIGS. 4, 5 and 6, a safety container in accordance with the invention, which is adapted to protectively enclose a utensil of the type shown in FIGS. 1 to 3 or a similar type having a ferrite heating element without interfering with baking operations, has a box-like form constituted by complementary upper and lower sections 20 and 21. These are interhinged on one side, so that the upper section 20 functions as a cover that can be raised to admit or withdraw the utensil.

The container is molded of polypropylene or other plastic material non-reactive to microwave energy and unaffected by the elevated temperature produced in the baking operation in a microwave oven. The sections are perforated to expedite cooling of the mold assembly after the container is removed from the microwave oven. Lower section 21 may be provided with feet 22 which raise the container above the surface on which it is placed. The hinge 23 for the container is a living hinge of the same plastic as the container itself.

At the front of upper section 20 of the container is a temperature-sensitive bimetallic strip 24 whose upper end is anchored on this section and whose lower end 25 which extends into lower section 21 is in a hook formation that is engageable by a non-metallic catch 26 on the lower section. When the temperature of the strip is raised as a result of heat produced by the heating element of the assembly, strip 24 then bends in to cause hook 25 to engage catch 26, thereby latching the container. But when the mold assembly is close to room temperature and is safe to handle, the strip bends out to unlatch the container.

FIG. 6 shows an operating microwave oven, represented by block 27, within which is placed the baking utensil 10 utensil 10 is then protectively enclosed in the safety container formed by sections 20 and 21. The child or adult who puts the loaded safety container in the microwave oven and then turns on the oven does not know exactly how long it takes to complete the baking operations; that is five to eight minutes, or whatever time it takes for baking to be completed.

But if the microwave oven is set for say 10 minutes, or for a longer period beyond that estimated baking time then at the end of this period, baking will have been completed. No danger exists in running the microwave oven for a longer period, than it takes to complete baking, for the ferrite heating element not only acts to heat the food contained in the utensil, but also the bimetallic element which then acts to latch the safety container while it is within the microwave oven. But the container itself remains relatively cool. And the Curie point of the ferrite heating element is such as to cut off thermal heating when the baking temperature exceeds a predetermined level.

When the microwave oven is shut off, and one removes the loaded latched container from the oven, one is then not able to remove the hot utensil from the container, for the container is still latched and remains latched until the utensil has cooled to a degree causing the container to automatically unlatch. It is at this point that the utensil may be safely removed from the container, and the baked food removed from the utensil.

Thus a utensil in accordance with the invention makes it possible to cook or bake a food product in a microwave oven without having to know how long it takes to bake the product, and without having to set the microwave timer to a predetermined baking period, for the utensil itself terminates the cooking heat when it reaches a predetermined level.

And the safety container makes it possible to carry out cooking with this utensil in a microwave oven without running the risk that the operator will handle the utensil while it is still so hot as to scorch the operator's fingers, for the operator is denied access to the utensil housed in the container while it is still too hot to handle.

While there has been shown a preferred embodiment of the invention, it will be appreciated that many changes may be made therein without departing from the underlying concept.

We claim:

1. A safety container for a baking utensil useable in a microwave oven to cook food held in the utensil, the utensil being provided with a heating element having ferrite particles which absorb microwave energy to produce thermal heat to heat the food, said container comprising:

A. separable upper and lower sections formed of a material insensitive to microwave energy for housing the utensil; and B. temperature-sensitive latching means that latch the sections together when the heating element of the utensil housed in the container raises the temperature of the utensil to a high level well above room temperature and automatically unlatch the sections when the temperature of the utensil is relatively cool and one can then safely remove the utensil from the container.

2. A container as set forth in claim 1 in which the sections are fabricated of synthetic plastic material.

3. A container as set forth in claim 2, in which said upper and lower sections are interhinged by a living hinge.

4. A container as set forth in claim 2, in which the lower section is provided with legs to raise the container within the oven.

5. A safety container as set forth in claim 1, in which said latching means include a bendable bimetallic strip secured to and extending from the upper section into the lower section, and a catch secured to the lower section and engaged by the strip when the temperature is at said high temperature and said strip is then bent in, said strip bending out to disengage said catcher when the temperature is cool.

6. A container as set forth in claim 1, in which at least one section is perforated to promote cooling of the utensil when the container is removed from the oven after cooking is completed.

7. A container for a baking utensil as set forth in claim 1, in which the utensil is formed of metal and the heating element is formed by an epoxy matrix bonded to the metal and having said ferrite particles dispersed therein.

* * * * *